US008317217B2

(12) United States Patent
Zemp

(10) Patent No.: US 8,317,217 B2
(45) Date of Patent: Nov. 27, 2012

(54) SKI SKIN MADE DIRECTIONALLY ORIENTED FLOCK

(75) Inventor: Niklaus Zemp, Neuenkirch (CH)

(73) Assignee: Ferfil Multifils SA, Emmenbruecke (CH)

( * ) Notice: Subject to any disclaimer, the term of this patent is extended or adjusted under 35 U.S.C. 154(b) by 247 days.

(21) Appl. No.: 12/665,115

(22) PCT Filed: Jun. 5, 2008

(86) PCT No.: PCT/CH2008/000252

§ 371 (c)(1), (2), (4) Date: Dec. 17, 2009

(87) PCT Pub. No.: WO2008/154758

PCT Pub. Date: Dec. 24, 2008

(65) Prior Publication Data

US 2010/0194075 A1 Aug. 5, 2010

(30) Foreign Application Priority Data

Jun. 20, 2007 (CH) ..... 0990/07

(51) Int. Cl.
*A63C 5/00* (2006.01)
*A63C 11/00* (2006.01)

(52) U.S. Cl. ..... 280/604; 280/601; 280/809

(58) Field of Classification Search ..... 280/604, 280/601, 610, 809
See application file for complete search history.

(56) References Cited

U.S. PATENT DOCUMENTS

| | | | | |
|---|---|---|---|---|
| 1,783,833 | A * | 12/1930 | Elsner | 280/604 |
| 2,189,760 | A * | 2/1940 | Matthee et al. | 280/604 |
| 2,287,252 | A * | 6/1942 | Kaufmann | 280/604 |
| 4,148,500 | A * | 4/1979 | Nidecker | 280/604 |
| 4,595,215 | A * | 6/1986 | Tiitola | 280/604 |
| 4,844,500 | A * | 7/1989 | Fischer | 280/604 |
| 6,105,990 | A * | 8/2000 | Sutherland | 280/604 |
| 6,471,234 | B2 * | 10/2002 | Ayliffe | 280/604 |
| 6,837,512 | B2 * | 1/2005 | Long | 280/604 |
| 7,540,525 | B2 * | 6/2009 | Ametsbichler et al. | 280/604 |
| 2006/0267332 | A1 * | 11/2006 | Fischli | 280/809 |
| 2008/0185817 | A1 * | 8/2008 | Gyr | 280/604 |
| 2010/0239808 | A1 * | 9/2010 | Schwitter | 428/96 |
| 2012/0161422 | A1 * | 6/2012 | Elliott | 280/604 |

FOREIGN PATENT DOCUMENTS

| | | |
|---|---|---|
| DE | 202 20 713 | 3/2004 |
| EP | 0 246 476 | 11/1987 |
| FR | 2 077 645 | 11/1971 |
| GB | 312 813 | 6/1929 |
| GB | 1 034 942 | 7/1966 |

* cited by examiner

*Primary Examiner* — J. Allen Shriver, II
*Assistant Examiner* — James M Dolak
(74) *Attorney, Agent, or Firm* — Michael J. Striker

(57) ABSTRACT

A ski skin includes a directionally oriented flock applied to a carrier surface. The flocked textile material may be further processed directly (glue application, assembly) as skin, or it may be laminated onto other, additional carriers. The fibers of the directionally oriented flock extend at an acute angle relative to the carrier layer.

8 Claims, 1 Drawing Sheet

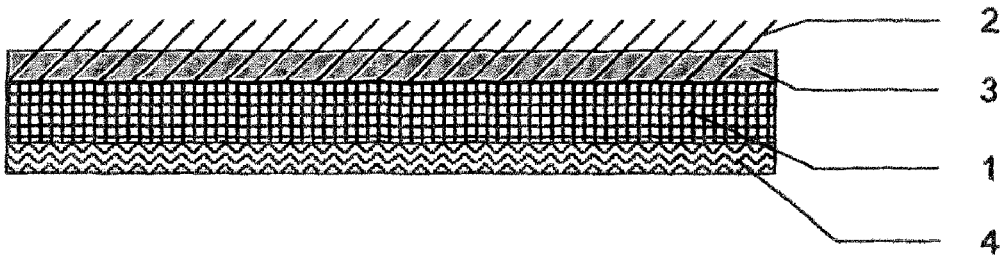
2
3
1
4

SKI SKIN MADE DIRECTIONALLY ORIENTED FLOCK

BACKGROUND OF THE INVENTION

The present invention relates to a ski skin composed of a carrier surface coated with glue.

Ski skins or ski climbing skins are known. They are used as climbing aids when climbing mountains on skis in snow in steep terrain. They are attached to the underside of a ski using glue. They must glide when traveling uphill, and they must not slip backward, i.e., downward.

Ski skins are typically made of a velvety fabric such as pile fabric or plush, the fibers of which are manufactured using thermal influences, and are directionally oriented and fixed in position via swissing/decatizing. The skin fabric itself is often laminated with a carrier fabric. Glue (hot-melt adhesive) is applied to the laminating fabric to enable the skin to bond to the skis. The known ski skins are composed, e.g., of a mohair material made of goat hair or a blended fabric of natural fibers and synthetic fibers (DE 20220713 U1).

GB 312 813 makes known a gliding-surface device, which is composed of a cloth panel having warp and weft and is used to climb uphill on skis. Adhesive elements are wrapped around the weft threads in order to anchor them. The adhesive elements are composed of metal wires and bristles which are not described further.

EP 0 246 476 likewise makes known flocked panels having a textile-like appearance. However, these panels are not suited for use as ski skins since they do not have the properties described above.

The inconsistent quality of the plush-like materials/fabrics, and the elaborate manufacturing process always result in large fluctuations in quality, which has a strong negative impact on the production costs and the use-value.

SUMMARY OF THE INVENTION

The object of the present invention, therefore, is to provide a ski skin that eliminates the above-noted disadvantages and enables entirely new properties (climbing behavior, etc.) to be realized.

This object is attained, according to the present invention, in that a directionally oriented flock is applied to a carrier surface. The flocked textile material may be further processed directly (glue application, assembly) as skin, or it may be laminated onto other, additional carriers.

It is essential that the fibers of the directionally oriented flock extend at an acute angle relative to the carrier layer. It has been shown that an angle $\alpha$ of between 10° and 80°, preferably 20° to 75°, and in particular 30° to 75°, is most suitable. At angles greater than 80°, it is nearly impossible to glide while climbing. At an angle below 10°, the ski, with the ski skin attached, slips backward slightly, and its functionality is no longer ensured.

The carrier panel is preferably composed of a textile material, in particular a formed fabric, to which the flock layer is applied electrostatically, in a known manner.

However, the carrier panel may also be composed of a fabric made of synthetic fibers or blends thereof, onto which the flock layer is applied. It is also possible to apply a directionally oriented flock layer to any combinations of formed fabric and cloth or laminated combinations thereof.

A carrier panel composed of a thermoplastic may likewise be used.

The flock is preferably anchored to the carrier panel using glue. The glue must ensure that the flock is anchored, and it must be flexible and capable of withstanding high and low temperatures between +50° C. and −40° C., which may occur during manufacture of the ski skin and while they are being used in snow. It is preferably composed of a plastic or a cross-linkable plastic dispersion.

The flock that is used may be composed of synthetic fibers that may be processed into flock.

It is particularly preferable to process a directionally oriented flock out of a thermoplastic. The plastic may be composed of a polyamide, polyethylene terephthalate, or another stringy thermoplast.

The preferred flock has a titer of 0.1 dtex to 280 dtex, in particular 0.5 dtex to 280 dtex, and preferably 0.5 dtex to 280 dtex. Below 0.1 dtex, the fibers are too soft and flexible; above 280 dtex, they are too stiff, and are incapable of being processed.

A length of the flock of 0.5 mm to 10 mm, preferably 0.2 mm to 8 mm, and in particular 0.2 mm to 5 mm has proven particularly effective in practical applications in terms of easy gliding and holding on the part of the ski skin.

A ski skin composed of a carrier panel and a directionally oriented flock has the advantage that it may be manufactured cost-effectively under stable production conditions.

BRIEF DESCRIPTION OF THE DRAWINGS

The present invention is explained in greater detail with reference to a drawing.

FIG. 1 shows a cross section of the ski skin according to the present invention.

DETAILED DESCRIPTION OF THE PREFERRED EMBODIMENTS

A carrier panel labeled with reference numeral 1 is shown in FIG. 1. Carrier panel 1 may be composed of a single layer or multiple layers. A glue layer 3 is applied to one side of carrier panel 1 in order to anchor a flock 2 oriented at an angle $\alpha$. A known glue 4 for adhesion to a ski is applied to the other side of carrier panel 1.

What is claimed is:

1. A ski skin, comprising:

a carrier panel having a first surface and a second, oppositely disposed surface;

a first glue layer (3) applied to the first surface of said carrier panel;

a second glue layer (4) applied to the second surface of said carrier panel for fixing said second surface of said carrier panel to a surface of a ski;

a textile flock (2) applied to the first glue layer (3) on said first surface of said carrier panel, wherein said textile flock (2) comprises directionally oriented fibers, said fibers extending at an acute angle relative to the first surface of the carrier panel.

2. The ski skin as recited in claim 1, wherein the carrier panel is a formed fabric.

3. The ski skin as recited in claim 1, wherein the carrier panel is a textile fabric.

4. The ski skin as recited in claim 3, wherein the textile fabric is a thermoplastic.

5. The ski skin as recited in claim 1, wherein the carrier panel is coated with a plastic in order to anchor the flock (2).

6. The ski skin as recited in claim 1, wherein the flock (3) oriented at an angle $\alpha$is composed of thermoplastic resins.

7. The ski skin as recited in claim 5, wherein the flock (3) has a titer of 0.5 dtex to 280 dtex.

8. The ski skin as recited in claim 6, wherein the flock (3) has a length of 0.5 mm to 10 mm.

* * * * *